United States Patent [19]

Dolan

[11] 4,157,776

[45] Jun. 12, 1979

[54] CLOTHES HANGER

[76] Inventor: John E. Dolan, Old Orchard St., Harrison, N.Y. 10528

[21] Appl. No.: 860,743

[22] Filed: Dec. 14, 1977

[51] Int. Cl.[2] ..... A47J 51/093

[52] U.S. Cl. ..... 223/92

[58] Field of Search ..... 223/92, 88, 85, 93, 223/98

[56] References Cited

U.S. PATENT DOCUMENTS

| | | | |
|---|---|---|---|
| 1,320,445 | 11/1919 | Butrick | 223/92 |
| 1,321,997 | 11/1919 | Duberstein | 223/92 |
| 2,240,885 | 5/1941 | Crocker | 223/92 |
| 3,059,824 | 10/1962 | Henry | 223/88 |
| 4,029,239 | 6/1977 | Dolan | 223/85 |

FOREIGN PATENT DOCUMENTS

| | | | |
|---|---|---|---|
| 527504 | 5/1955 | Italy | 223/92 |

*Primary Examiner*—George H. Krizmanich
*Attorney, Agent, or Firm*—John F. Ohlandt

[57] ABSTRACT

A plastic clothes hanger comprising an elongated, substantially enclosed, hollow plastic body having extending arms.

2 Claims, 3 Drawing Figures

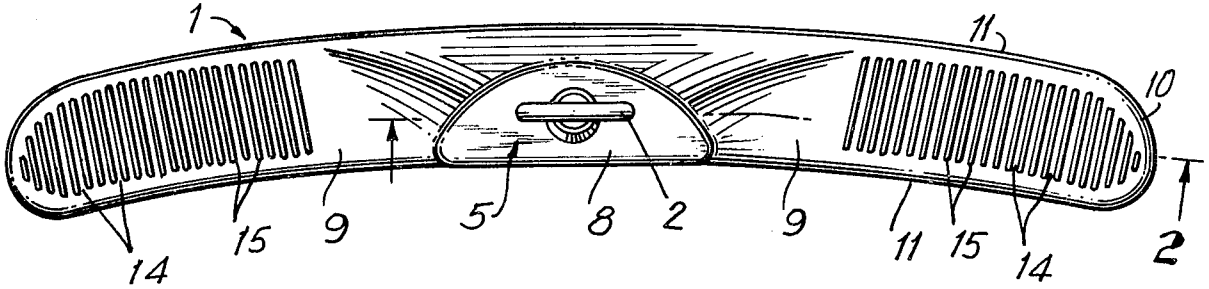
FIG. 1
FIG. 3
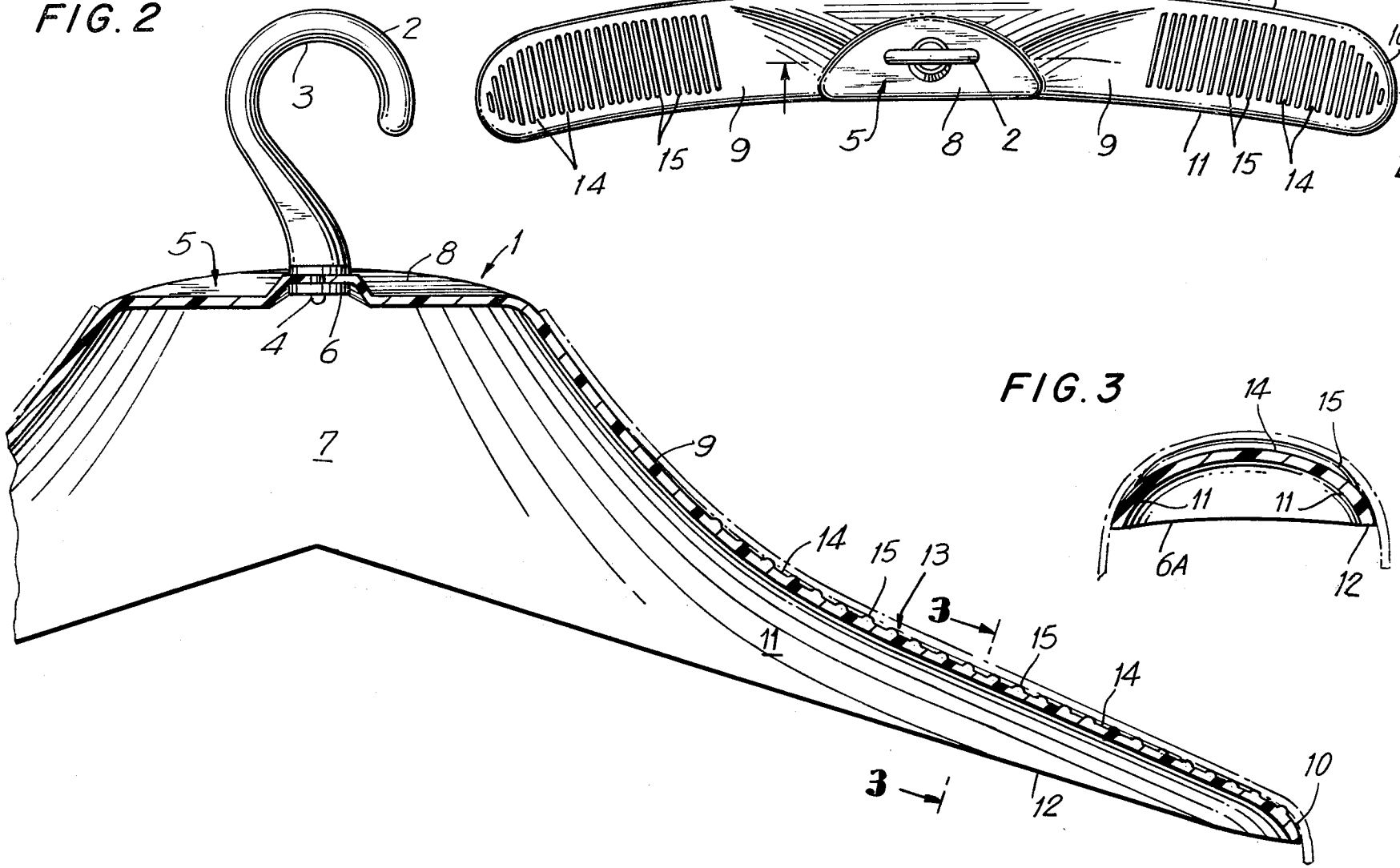
FIG. 2

CLOTHES HANGER

BACKGROUND, OBJECTS AND SUMMARY OF THE INVENTION

The present invention relates to clothes hangers, and more particularly, to improvements in a light-weight clothes hanger especially adapted for use with wet clothing. The present invention is a particular improvement over the clothes hanger disclosed in related application Ser. No. 652,231, now U.S. Pat. No. 4,029,239, issued to the present applicant.

A variety of devices have been known in the art for the purpose of hanging clothing; for example, the well-known standard wooden clothes hanger which is usually provided with a varnish coating or the like. Such a hanger is vulnerable to moisture and to wear whereby the varnish is easily removed, and therefore the hanger is especially unsuitable for use with wet clothing.

It is often desirable, and particularly is it the case with wet clothing, that greater than usual spacing be provided between the front and back of the hanger so that the front of the garment may be prevented from touching the back, whereby much greater circulation of air will be promoted and hence more rapid drying of the garment will be achieved. The obvious disadvantage of the aforesaid wooden hanger in this respect is that, in order to achieve the foregoing objective, it has to be made quite thick or made in such a formidable shape or contour that it becomes a very expensive proposition.

It has been known, of course, to form a clothes hanger or the like of synthetic plastic material. As background for an appreciation of the present invention, reference can be made to the following U.S. and foreign patents in which plastic clothes hangers are described:

U.S. Pat. Nos. 3,425,604 and 3,581,959
Italian Pat. No. 523,183
Canadian Pat. No. 451,153

Other patents that may be referred to are:

Swedish Pat. No. 181,525
U.S. Pat. Nos. 1,321,997 and 3,289,901
U.S. Design Pat. No. 124,556

The clothes hanger of the present invention generally seeks to achieve the objectives previously pointed out in U.S. Pat. No. 4,029,239; that is, to attain a clothes hanger construction which is appropriately directed to promoting the efficient shedding of water from a garment that has been hung to dry, as well as to eliminate dust which tends to accumulate on the shoulders of such garment if it is left on the hanger for long periods of time.

The invention of the aforesaid U.S. Pat. No. 4,029,239, while achieving its desired objects in an economical way, does so by means of a clothes hanger which comprises an elongated, but fully enclosed, hollow light-weight plastic body. It has since been discovered, however, that the desirable strength characteristics associated with the invention of that patent, which characteristics are necessary for permitting the hanger to be subjected to rough treatment, can be completely achieved, and yet other important and desirable objects can be realized, by making the plastic body substantially enclosed rather than fully enclosed.

Thus it has been found that a particular process of forming the hanger, which involves substantially eliminating the bottom web or wall of the hanger, still yields a very strong construction, yet allows for the ability to stack a great number of hangers for shipping and storage. In other words, because the bottom wall is no longer present, the hangers can be brought together in close array. Additionally, such construction results in the need for much less material in order to obtain the desirable strength characteristics. Moreover, the body can be molded by injection molding, which further means that the process of producing the body can be cheaper, the hanger can be made much more quickly, and there is greater control over the shape of the hanger, particularly with regard to the thickness that is attainable.

The above and other objects are fulfilled by the several features herein disclosed, the primary of which is the provision of a clothes hanger comprising an elongated substantially enclosed, hollow light-weight plastic body. The plastic body is constituted of a large central truncated conical section; more specifically, the central truncated conical section extends vertically from the upper surface of the hanger to the lower part of the section for a distance approximately one-half of the full vertical dimension of the hollow plastic body. As a result, the hanger possesses extremely good strength characteristics and, because of the opening provided due to complete removal of the lower or bottom wall, the hanger can be formed by injection molding of light-weight plastic and is stackable with like hangers.

The plastic hollow body for the clothes hanger of the present invention, in addition to the central truncated conical section to which a hook may be extended, also includes two symmetrical hollow arms diverging downwardly. These arms deviate or curve away from what may be termed a normal vertical plane, such vertical plane being defined as that which is operative when the hanger is appropriately hung on a suitable clothes rod or the like. The thus achieved curvilinear shape for the arms means that clothing supported on the hanger, whether it be in the dry or wet state, will keep its shape better because such shape puts light tension on the hung garment thereby to eliminate wrinkles in its back.

In a typical construction, the arms have a width of approximately two inches, thereby providing the requisite spacing as noted previously.

The clothes hanger of the present invention shares certain features with that previously disclosed in U.S. Pat. No. 4,029,239. First, the upper surfaces of the extending arms are fully rounded; that is, they are convexly shaped upwardly so that when a garment is hung, dust lines on the shoulder of such garment are eliminated, even though the garment may be hung for a considerable period of time. In other words, the very nature of the upper surface prevents dust accumulation. Another feature resides in the provision that the back wall of the central conical section of the hanger merges with the rearward surfaces of the extending arms and is integral therewith; also, the lower surfaces of the arms which have been reduced in accordance with the present invention to very slight dimensions are inclined upwardly toward the central vertical axis of the hanger.

Other and further objects, advantages and features of the present invention will be understood by reference to the following specification in conjunction with the annexed drawing, wherein like parts have been given like numbers.

BRIEF DESCRIPTION OF THE DRAWING

FIG. 1 is a top plan view of a clothes hanger in accordance with the preferred embodiment of the present invention;

FIG. 2 is a fragmentary vertical sectional view taken on the line 2—2 in FIG. 1; and FIG. 3 is a vertical sectional view taken on the line 3—3 in FIG. 2.

DESCRIPTION OF PREFERRED EMBODIMENT

Referring now to the figures, and for the moment to FIG. 1, there is illustrated a clothes hanger 1 adapted to be suspended by a hook 2, the hook being formed separately and having an appropriately curved upward part 3 so as to engage a clothes rod or the like and having a thin shank 4. The hook 2 extends through the upper part of a hollow body 5 defining the clothes hanger and the hook is affixed by a suitable press-fitted nut 6.

The body 5, which is constituted of a plastic material such as polyethylene, is in accordance with the present invention formed by a technique known as injection molding. By such technique, as indicated previously, the body can be readily formed so as to have a substantial large opening 6A in the lower or bottom wall. Accordingly, the bottom wall or web is constituted solely of the remaining rim portion 12. Thus it will be understood that the body 5 is constituted of a substantially enclosed structure having a deep or extended central conical section. This conical section 7 is provided with a flat upper surface 8. A pair of arms 9 diverge downwardly from the central section, terminating in rounded tips 10. Each arm 9 may be said to comprise front and rear side walls 11 which merge and are integral with the respective front and rear walls of the central section 7. The lower or bottom surfaces of the arms 9, corresponding with rim portion 12, extend inwardly and upwardly and merge with the central section.

In the circumstance that clothes that have just been washed are placed on the hanger 1, their drying will be promoted because of the grooves 14 which extend from front to rear along the convex surfaces 13 of the arms 9. In the particular embodiment these grooves 14 are depicted as being defined by ridges 15 which are integrally formed in the injection molding process for forming the body 5. Since the convex upward surfaces 13 of the arms 9 define the bottoms of grooves 14, such grooves readily enable water to run out of the shoulders of the garment toward the front and rear of the garment so as to enhance the drying operation. This is particularly important in the case of a shirt so that the shoulders of a shirt will dry quickly and evenly, resulting in fewer wrinkles.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. A clothes drying hanger comprising a unitary, substantially enclosed, hollow plastic body having a central truncated conical section which extends vertically from its upper surface to a lower web for a distance of approximately one-half of the full vertical dimension of said hollow plastic body, and a pair of downwardly diverging arms;

said body including substantially spaced front and back walls curving from a normal vertical plane, the upper surfaces of each of said arms being upwardly convex in the transverse direction;

a substantial opening defined by said lower web of said enclosed hollow plastic body such that only a rim portion thereof remains which extends in an upward inclination toward the central vertical axis of the body;

a series of transverse, closely spaced grooves in a substantially continuous, sinuous cross-sectional configuration along the length of said arms, said grooves being inclined along the length of said arms and being integrally formed to follow the transverse convex contour of said upper surfaces.

2. A clothes hanger as defined in claim 1, including a hook member extending through suitable aperture in the upper surface of the conical section.

* * * * *